United States Patent [19]

Nijs

[11] 4,369,941

[45] Jan. 25, 1983

[54] REINFORCING STRIP

[75] Inventor: Marc Nijs, Moorslede, Belgium

[73] Assignee: N.V. Bekaert S.A., Zwevegem, Belgium

[21] Appl. No.: 194,129

[22] Filed: Oct. 6, 1980

[30] Foreign Application Priority Data

Oct. 9, 1979 [GB] United Kingdom ..... 7935038

[51] Int. Cl.[3] ..... B21F 27/00

[52] U.S. Cl. ..... 245/2; 428/258

[58] Field of Search ..... 245/1, 2, 3, 4, 5, 6, 245/10, 11; 140/5, 12, 112; 138/173, 174, 175, 176; 428/229, 258, 592

[56] References Cited

U.S. PATENT DOCUMENTS 2,125,583 8/1938 Reed .

3,838,837 10/1974 Tolliver ..... 245/1

4,305,433 12/1981 Vanassche et al. ..... 245/2 X

FOREIGN PATENT DOCUMENTS 2315519 3/1974 Fed. Rep. of Germany .

725826 3/1955 United Kingdom .

1494515 12/1977 United Kingdom .

*Primary Examiner*—Mark Rosenbaum

*Attorney, Agent, or Firm*—Edward J. Brenner

[57] ABSTRACT

A reinforcing strip of wire mesh for coatings on pipes, comprising a plurality of parallel longitudinally running warp wires provided with incurvations for giving the strip a longitudinal extensibility which increases gradually along the breadth of the strip. The adjacent warp wires are connected by obliquely running weft wires which are welded to the warp wires in the crossing points, preferably by one single continuous weft wire running in zigzag along the length of the strip.

4 Claims, 3 Drawing Figures

REINFORCING STRIP

Figure 1:
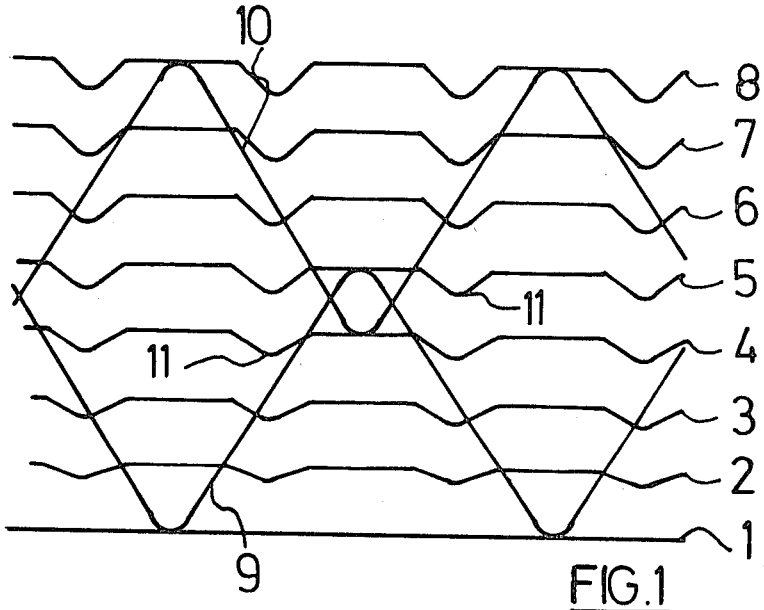

This invention relates to a reinforcing strip of wire mesh which is particularly applicable for unrolling from a cylindrical bobbin (developed surface is a straight strip) and wrapping up on a truncated cone form (developed surface becomes a strip running along the arc of a circle) for reinforcing purposes. Between unrolling and wrapping up, the developed surface of the strip changes from a straight strip to a strip running according to the arc of a circle, and consequently, the strip undergoes a longitudinal deformation, which gradually changes along the breadth of the strip.

Such deformable strips are known for reinforcing the concrete coatings on oil pipes. Usually, the breadth ranges between b 15 and 25 centimeter, and the transverse cross section comprises 6 to 20 wires of a diameter ranging from 1 to 3 millimeter and a tensile strength of 300 to 500 Newton per square millimeter. The wires are deformed in order to give the strip an extensibility of a low modulus, this means, where the force per unity of extension length is low, in order to obtain extension with forces which can easily be developed when wrapping up. This modulus can be considered sufficiently low when substantial extension of the strip can be obtained with a force that does not exceed 160 Newton per square millimeter total cross-sectional area of wire, when the strip is cut transversally. Hence, conventional crimped wire is in general not suitable and less incurvations are used, but of greater amplitude, than in conventional crimped wire. In general, the incurvations in a wire are limited to an average of not more than 10° per millimeter of wire length.

Not all sorts of strips are equally easy to make or to apply, of equal quality or equally expensive for a same reinforcing ability. One sort of wire mesh has a good extensibility in use, but is only made on slow and complicated machines, whereas the other sort has less extensibility, but can be made cheaper and on less complicated machines, but appears to have manufacturing defects, etc.

It is the purpose of the present invention to provide a new sort of strip which is cheap to manufacture with simple equipment, of good quality, easy to apply and having a good reinforcing ability.

According to the invention, the reinforcing strip comprises a plurality of substantially parallel longitudinally extending warp wires the whole of these wires comprising a plurality of incurved portions which provide the strip with a longitudinal low modulus extensibility which increases gradually along the breadth of the strip, adjacent warp wires being connected with transverse wire portions running obliquely from one warp wire to the adjacent one, and welded to these wires in the crossing points.

Welded wire mesh procures in general the advantage that, for a same strength, less and thicker wires can be used which must not be twisted together as in hexagonal woven structures. When however using welded wire mesh with longitudinal warp wires with gradually increasing extensibility along the breadth of the strip, then, when wrapped on the truncated cone surface, all longitudinal wires come in stretched position between the welding points, and a minimum of wire is lost. But the wire is deformed and comes to follow a broken arc line, where the bends come precisely in the welding points. Consequently it is important that the weldings be of a good quality. And it is also desirable that these weldings can be made at high speed with simple equipment. This is the case when the transverse wires do not run precisely perpendicularly to the longitudinal wires. When they run obliquely, this means substantially not perpendicularly to the longitudinal wires, then the welds can reliably be made between two welding rollers. The parallel running warp wires, with the transverse wire portions laid thereupon, are continuously passed between two copper rollers of which the breadth is slightly more than the breadth of the strip, and between which the welding tension is applied. Because the transverse wires run obliquely, the different crossing points pass one after another along the welding line between the welding rollers, and the weldings are made one by one in a continuous process. If a plurality of weldings would have come at the same time along the welding line, then the problem of reliable distribution of the welding current over the several welding points, and of reliable weldings in points where precisely the bendings occur when using the structure, would have made this continuous process between two welding rollers unusable.

Figure 2:
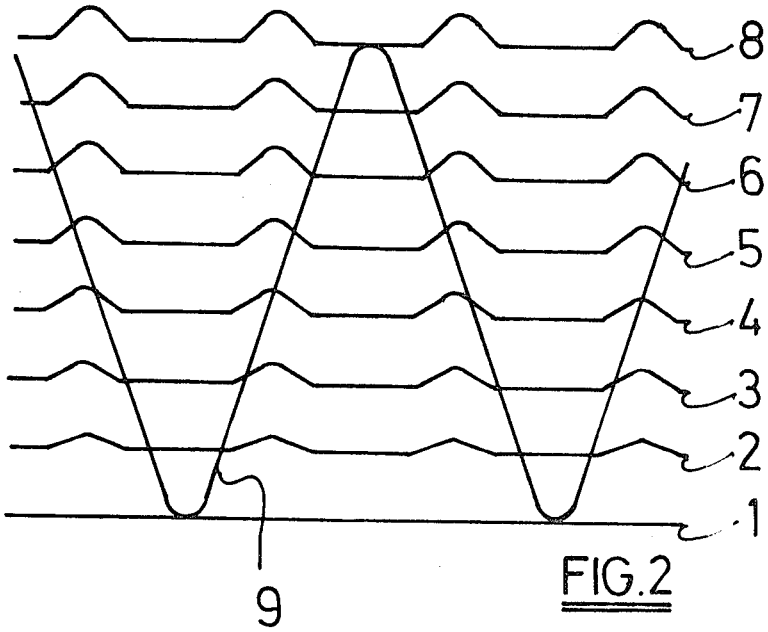
Figure 3:
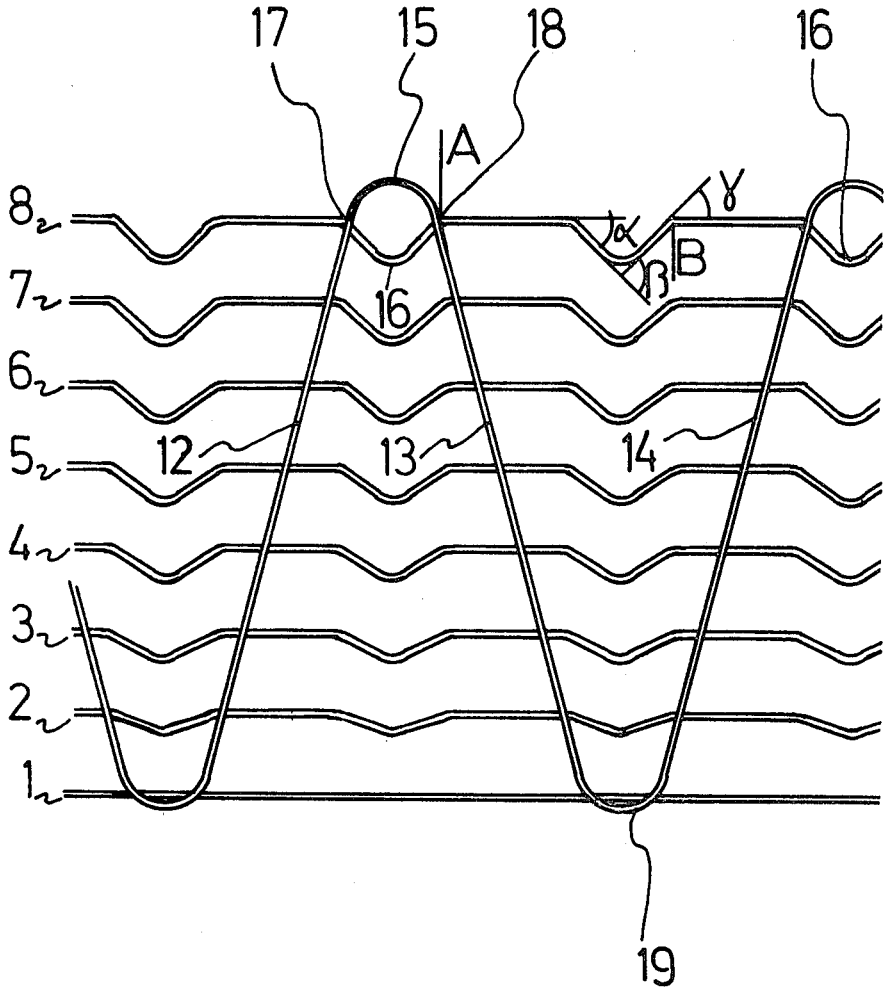

The accompanying drawings relate to a preferred embodiment, given by way of example, in which FIG. 1 shows a first embodiment of the reinforcing strip according to the invention, FIG. 2 shows a second embodiment and FIG. 3 a third embodiment.

In FIG. 1, the strip comprises eight longitudinally extending wires 1 to 8 and two wires 9 and 10 extending the length of the strip in zigzag-form over the breadth of the group of wires 1 to 5 and 4 to 8 respectively. Weft wire 9 is welded to longitudinal wires 1 to 5 and weft wire 10 to longitudinal wires 4 to 8 in the cross-points. By zigzag-form is meant, in general, that the wire, whilst running in the longitudinal direction, also travels back and forth between one side of the covered breadth to the other one. This can produce sawtooth-forms, as for wires 9 and 10, or sinusoids, or other forms, crimped or not.

Each of the warp wires 2 to 8 comprises incurved portions 11 at regular intervals and of the same magnitude in the plane of the strip. The incurvations increase from wire 2 to 8, so providing the strip with a longitudinal extensibility which increases gradually along the breadth of the strip from zero extensibility at wire 1 to maximum at wire 8. This effect can in general be obtained by distributing the incurvations in the proper number and amplitude over the warp wires. One wire must not necessarily have incurvations, as is the case with wire 1 in this example, and the incurvations themselves can all be of the same magnitude, but vary in frequency from wire to wire, or inversely, vary in magnitude, but be invariable in frequency, in order to reach a gradually increasing extensibility over the breadth. A substantially linearly increasing extensibility from zero is however preferred. In this embodiment, the distance between adjacent incurved portions 11 is 75 mm, the crimp increasing substantially linearly from 0% at wire 1 to 12% at wire 8, the distance between adjacent longitudinal wires being 25 mm, the wire thickness 2 mm, and the wire tensile strength about 330 Newton per square millimeter. Strengths in the range between 500 and 900 $N/m^2$ are also possible when desired when increasing the carbon content of the steel.

The embodiment of FIG. 2 is similar to that of FIG. 1, with the exception that a all warp wires are connected together by a simple weft wire 9, which runs in zigzag over the whole breadth of the strip. The wire 9 crosses the wires 2 to 7 at an angle of about 60°.

The embodiment of FIG. 3 is characterized by the fact that between each back and forth portion, 12, 13, 14 of the zigzag-form of the weft wire 9, there is only one incurved portion per warp wire, except wire 1, these portions being aligned perpendicularly to the longitudinal direction of the strip. Care must be taken that the bending 15 in the weft wire be at least of equal length as the portion 16 between the welding points 17 and 18. The portions 15 or 19 at the turning points of the zigzag-form in the weft wire may be cut off, but is preferred to keep the zigzag-form, because this avoids entangling of weft wire extremities on the bobbin and facilitates unrolling, which is an advantage of this continuous uninterrupted zigzag-form. In this embodiment, for instance, in wire 8 the average incurvation per centimeter of wire length is about 2,4° per centimeter. Indeed, the total incurvation $\alpha+\beta+\gamma$ (the angles becoming zero when the wire is stretched) is about $45°+90°+45°=180°$ for the length of 75 millimeter between A and B.

The strips according to FIGS. 1 to 3 are manufactured from a plurality of rolls of continuous wire. The longitudinal wires 1 to 8 are unrolled and led between rollers which impart the desired form and amplitude to the wires. The weft wire or wires are similarly drawn from rolls and formed, with or without crimping, into the desired sinusoidal of zigzag-shape, e.g. by weaving back and forth between teeth located on rings at the two axial extremities of a continuously rotating drum, e.g. continuously released from said drum. This zigzag-shape is then laid on the strip of parallel running longitudinal wires and the whole is led between rotating welding rollers which press the wires against each other and weld the wires together at their crossing points. Other manufacturing methods with other machine designs are possible, but it is clear that the design of this strip allows to design a continuous process, also welding, which is fast, procures reliable welding points, and with inexpensive machinery which is easy to transport. Such strips can thus be manufactured near the site at which they are to be used.

It is clear that other strips can be designed than those given in these examples, having the same characteristics and advantages.

I claim:

1. A reinforcing strip of wire mesh comprising a plurality of substantially parallel longitudinally extending warp wires, said plurality of warp wires comprising a plurality of incurved portions which provide the strip with a longitudinal low modulus extensibility which increases gradually along the breadth of the strip, adjacent warp wires being connected with transverse wire portions running obliquely from one warp wire to the adjacent one, and welded to these wire portions in the crossing points of said warp wires with said wire portions.

2. A reinforcing strip of wire mesh according to claim 1, in which the transverse wire portions which connect a group of adjacent warp wires, are formed by a single continuous weft wire extending the length of the strip in zigzag-form over the breadth of said group of adjacent warp wires and welded therewith in the crossing points with said warp wires.

3. A reinforcing strip of wire mesh according to claim 2, in which said group of adjacent warp wires comprises all warp wires.

4. A reinforcing strip according to claim 3, in which, between each back and forth portion of said zigzag-form of the weft wire, there is not more than one incurved portion per warp wire, these portions being aligned substantially perpendicularly to the longitudinal direction of the strip.

* * * * *